US006725585B2

(12) United States Patent
Hickle et al.

(10) Patent No.: US 6,725,585 B2
(45) Date of Patent: Apr. 27, 2004

(54) PERIPHERAL GUARD CONTROL FOR A GARMENT FINISHING PRESS

(75) Inventors: Ernest J. Hickle, New Market, TN (US); David G. Crockett, Morristown, TN (US); Joe Brogan, Dandridge, TN (US); Cleatis Buckner, Dandridge, TN (US)

(73) Assignee: Forenta, LP, Morristown, TN (US)

( * ) Notice: Subject to any disclaimer, the term of this patent is extended or adjusted under 35 U.S.C. 154(b) by 16 days.

(21) Appl. No.: 10/166,971

(22) Filed: Jun. 11, 2002

(65) Prior Publication Data

US 2003/0226295 A1 Dec. 11, 2003

(51) Int. Cl.[7] ..... D06F 71/06
(52) U.S. Cl. ..... 38/40
(58) Field of Search ..... 38/36, 37, 40, 38/1 C, 1 D, 17, 27, 26, 38, 39, 41; 23/94; 137/456; 100/341–349

(56) References Cited

U.S. PATENT DOCUMENTS

| | | | | | |
|---|---|---|---|---|---|
| 2,050,619 | A | * | 8/1936 | Mallot, Jr. | 192/133 |
| 2,472,656 | A | * | 6/1949 | Forse | 38/27 |
| 3,333,355 | A | * | 8/1967 | Tucker | 38/27 |
| 3,640,007 | A | * | 2/1972 | Richterkessing | 38/41 |
| 3,722,116 | A | * | 3/1973 | Beeley et al. | 38/27 |
| 3,986,281 | A | * | 10/1976 | Darwin | 38/17 |
| 4,280,290 | A | | 7/1981 | Anderson | |
| 4,399,624 | A | | 8/1983 | Ward | |
| 4,744,160 | A | | 5/1988 | Elliott et al. | |
| 4,809,450 | A | | 3/1989 | Hochstrasser et al. | |
| 4,910,894 | A | | 3/1990 | Vartan | |
| 5,014,453 | A | | 5/1991 | Gratsch | |
| 5,161,316 | A | | 11/1992 | Saito | |
| 5,474,216 | A | | 12/1995 | Harrod et al. | |
| 5,553,410 | A | | 9/1996 | Derby | |
| 5,636,773 | A | | 6/1997 | Harrod et al. | |
| 5,692,326 | A | | 12/1997 | Mohan et al. | |
| 5,711,097 | A | | 1/1998 | Mino | |
| 5,732,859 | A | | 3/1998 | LeBlanc | |
| 5,970,637 | A | | 10/1999 | Mohan et al. | |
| 6,119,379 | A | | 9/2000 | Hickle et al. | |
| 6,186,377 | B1 | | 2/2001 | McCormick et al. | |

* cited by examiner

*Primary Examiner*—Ismael Izaguirre
(74) *Attorney, Agent, or Firm*—Pitts & Brittian PC

(57) ABSTRACT

A peripheral safety guard apparatus for protection of an operator of a garment finishing press. The guard bar encircles the press head and includes connection to a pivotable connector member positioned to connect with a reciprocating activation device controlling actuating valves in communication with a source of pneumatic power for movement of the press head. Upon manipulation of the guard bar by an operator, the guard bar moves in advance of movement of the press head between an open, inoperative position and a closed, operative position. After manipulation of the guard bar, the activation device actuates valves with resulting movement by transfer of pneumatic power of the press head between inoperative and operative positions. Movement of the guard bar in advance of the press head between inoperative and operative positions, protects the operator from entrapment of a body part during downward movement of the press head to the operative position.

12 Claims, 7 Drawing Sheets

PERIPHERAL GUARD CONTROL FOR A GARMENT FINISHING PRESS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of Invention

This invention relates to an apparatus disposed to encircle a press head of a garment finishing press. More particularly, this invention relates to a peripheral safety guard control device to protect an operator of a press head of a garment finishing press.

2. Description of the Related Art

Numerous types of machines have been provided for the purpose of ironing and pressing textile materials and garments after washing or dry-cleaning operations. These machines include a press head which closes in a scissors like motion against a fixed pressing surface, known as the buck. Once closed, the machines may apply steam heat or electric heat, and/or pressure to smooth, press and dry the textile materials and garments. Typical of these modern machines is a power driven "scissors" style garment press machine which employs a pneumatic closing mechanism. When activated, the closing mechanism lowers the press head until it registers against the pressing surface of the buck.

Due to the danger the pneumatic power driven machines pose to an operator who catches a hand or other body part between the press head closing against the buck, safety standards have been developed requiring the operator to simultaneously manipulate two activators separated by distance great enough to require the use of both hands in order to effectuate the closing of the press, or the use of a peripheral safety bar. This requirement is formalized in a standard published by the American National Standards Institute (ANSI) for Commercial Laundry and Drycleaning Operations (ANSI Z8.1-1996, Section 4.4.2.1). European safety standards require that an operator-manipulated guard bar must precede the movement of the press head of a press machine, and require that a guard bar substantially surrounds the press head.

A conventional textile press may require the operator to press and hold a close button, which activates a pneumatic operated drive system which lowers the press head until it engages the buck in a closed position. Should the close button be released, the press head returns to the open, inoperative position. Alternatively, conventional textile press devices may include additional buttons or hand controls that must be manipulated by the operator to hold the press head in a closed position and to release the textile press head for opening. Prior art devices for closure and locking of a textile press are disclosed in U.S. Pat. No. 2,395,780, issued to Devol, Jr., et al. on Feb. 26, 1946, and U.S. Pat. No. 2,369,243, issued to Lechler on Feb. 13, 1945.

A peripheral guard bar apparatus is needed to protect a press operator during movement of a press head of a garment finishing machine. A peripheral guard bar is further needed that moves in advance of movement of a press head of a garment finishing machine in order to protect the operator from entrapment of a body part.

BRIEF SUMMARY OF THE INVENTION

In accordance with the present invention, there is provided a safety guard apparatus for movement of a press head of a press machine powered by a source of pneumatic power to operate the press head between inoperative and operative positions controlled by at least one actuatable valve. The safety guard apparatus includes a guard bar connectable to a connector means including a support member disposed to pivot in concert with the movement of the guard bar and a pressure lever and support lever arm attached to the press head. The guard bar is manipulated by an operator to actuate the at least one actuatable valve for activation of pneumatic fluid flow for movement of a pressure lever and the press head between inoperative and operative positions. The guard bar includes a front portion, first and second side portions and a rear portion configured to encircle the press head. The guard bar is disposed by the pivotable relationship to be moved in advance of movement of the connector means and the press head between an open, inoperative position and a closed, operative position to protect the operator from entrapment of a body part during downward movement of the press head.

An operator-responsive mechanism is interposed between the connector means and the at least one actuatable valve. The operator-responsive mechanism includes means for connecting having at least one pivotable connection between the guard bar rear portion and the connector means. The operator-responsive mechanism is responsive to the movement of the guard bar between inoperative and operative positions to regulate the transmission of pneumatic power for operation of the connector means and the press head between inoperative and operative positions upon manipulation of the guard bar by an operator.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
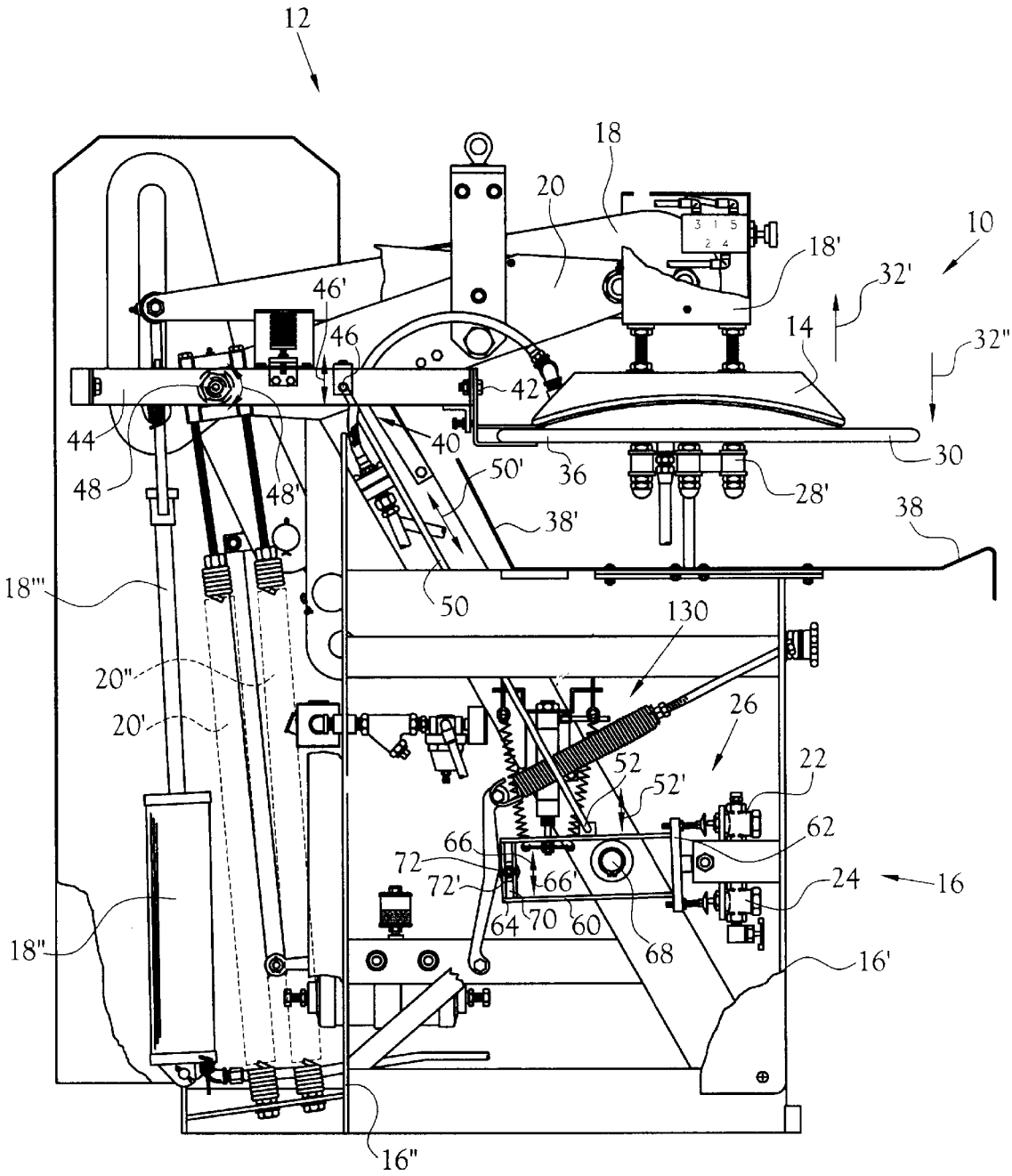
FIG. 1 is a side view of a press machine illustrating a peripheral guard bar of the present invention positioned in an operative position against a pressing surface.

A peripheral guard bar 10 for control of movement of a press head 14 of a garment finishing press machine 12 is illustrated generally in FIG. 1. One embodiment of the peripheral guard bar 10 includes an operator-manipulated guard bar 30, connected by a pivotable connector means 40 to an activation system 26 for actuation of at least one actuatable valve 22 for regulation of pneumatic fluid pressure supplied to a piston and cylinder 18" having a piston rod 18'" for movement of press head 14 between operative and inoperative positions (see FIGS. 1 and 3). The garment finishing press machine 12 includes a pressing surface 28 against which the press head 14 is positioned in an operative position for pressing garments. The press head 14 is connected at an upper surface to a cantilevered pressure lever 18 by a connector bracket 18'. A support lever arm 20 is aligned along the lateral sides of the pressure lever 18 for movement of the press head 14 between an inoperative, open position 32' (see FIG. 3) and an operative, closed position 32" against a pressing surface 28. The pressing surface 28 is supported by support bracket 28' above a front support frame 16' of a support frame 16. A front work shelf 38 and a rear work shelf 38' are attached under support bracket 28' (see FIG. 1). The pressure lever 18 and support lever arm 20 are supported by at least one structural member 16" of the support frame 16. The pressure lever 18, support lever arm 20 and press head 14 are moved by a pneumatic pressure system maintaining pneumatic fluid pressure provided by a source of pneumatic power (not shown). A rear frame 16" supports the rear portions of pressure lever 18 and support lever arm 20, which are pivoted in cantilevered movement by a piston rod 18'" extended from at least one piston and cylinder 18". Extension and retraction of piston rod 18'" is controlled by pneumatic fluid pressure, such as air pressure, transmitted by the reciprocation of least one actuatable valve 22, and preferably the reciprocation of two valves 22, 24. The support lever arm 20 is supported by at least one pair of connector rods and springs 20', 20" that bias the support lever arm 20 to an open position, for cantilevered movement in concert with pressure lever 18 to an open, inoperative position (see FIG. 3). Support lever arm 20 is pivotable about a pivot point (not shown), that is generally located proximal of pivot 46 or pivotable connection 48.

Figure 2:
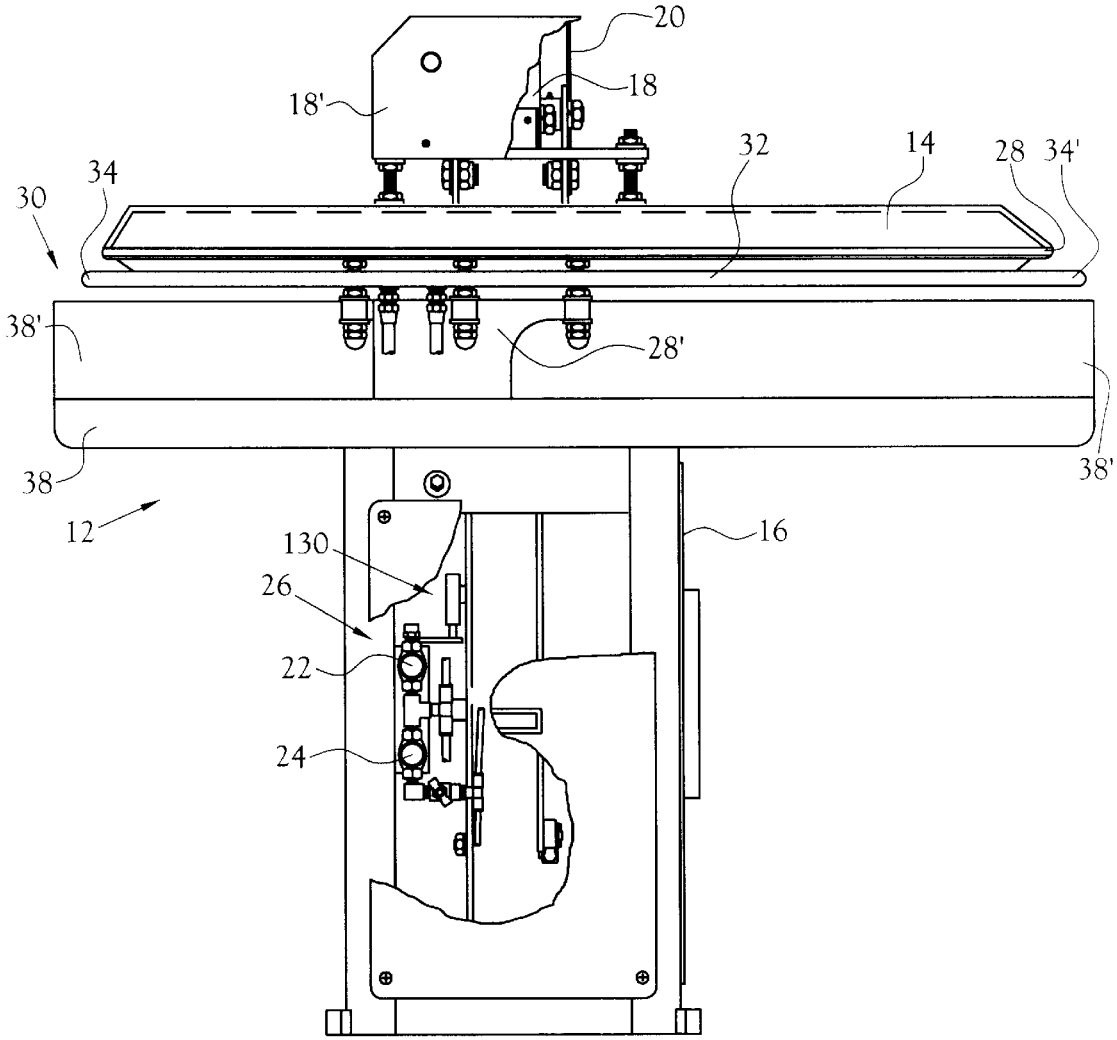
FIG. 2 is a front view of the press machine of FIG. 1, illustrating a peripheral guard bar in an operative position against a pressing surface.
Figure 5:
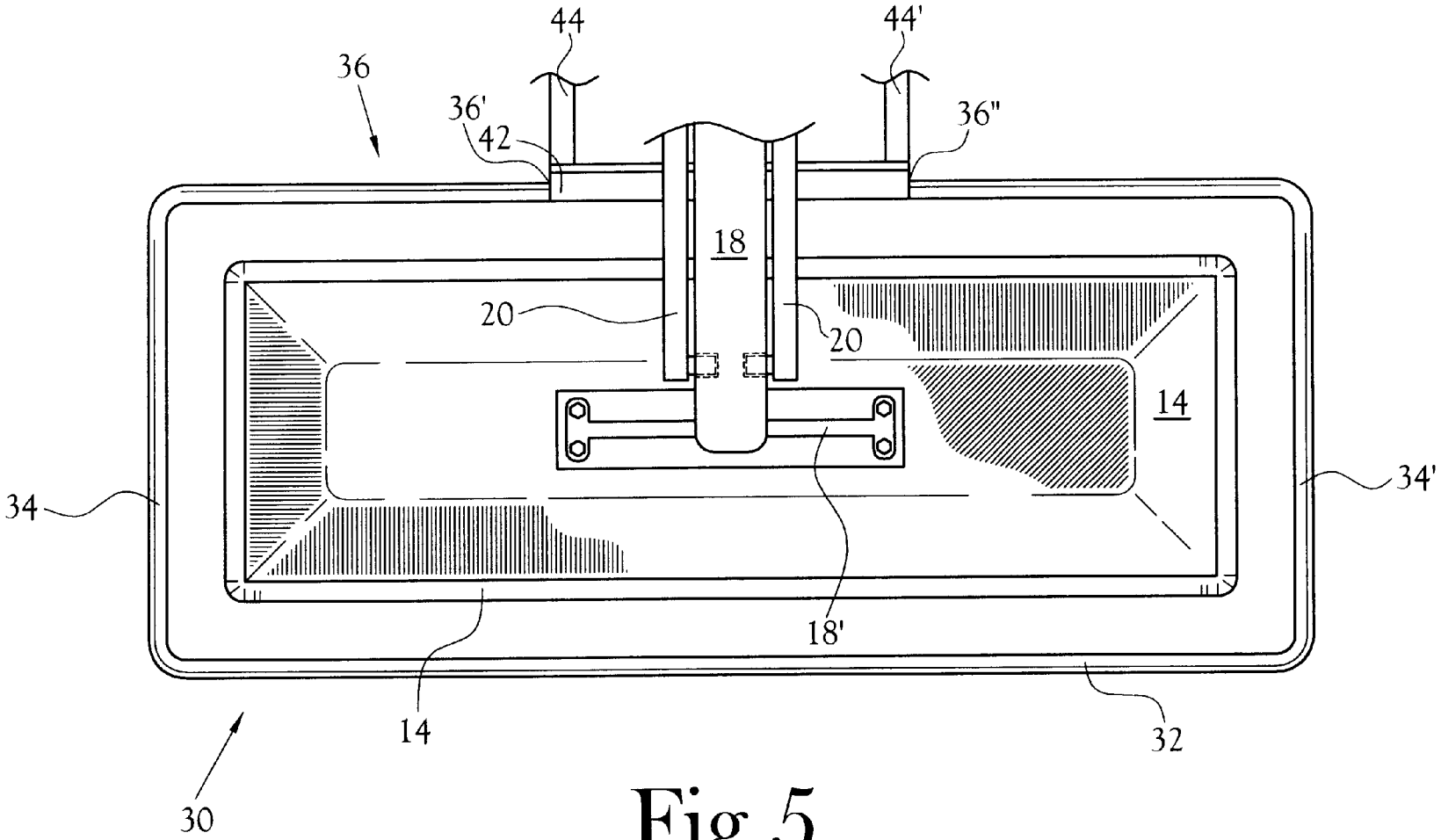
FIG. 5 is a top view of FIG. 1, illustrating the peripheral guard bar.

One embodiment of the present invention includes a guard bar 30 as illustrated in FIGS. 1 and 2. The guard bar 30 encircles the press head 14 and includes a front bar portion 32, a first side portion 34, a second side portion 34' and a rear portion 36 having interior bar ends 36', 36". The guard bar 30 is disposed to encircle the press head 14 slightly below a horizontal plane described by the lateral extension of a press surface of the press head 14 when positioned against the pressing surface 28 in the downwards, operative position 32". The bar rear portion 36 and bar ends 36', 36" are supported by a rear bar bracket 42 that connects the bar rear portion 36 to a connector means 40 including a substantially rigid support member 44 that is pivotably connected at a pivotable connection 48 to pivot in relation to the support lever arm 20. A second support member 44' is connected on an opposed side of support lever arm 20 (see FIG. 5), with the second support member 44' moved in concert with support member 44. The pivotable connection 48 is also connected to support lever arm 20, which supports the press head 14. Connectors for the rear bar bracket 42 can include an attaching means such as detachable bolts to allow the guard bar 30 to be replaceable with a like-configured guard bar or a guard bar having an alternate size configuration or an alternate angle of extension around the press head 14. The guard bar 30 is connected at the bar rear portion 36 to the rear bar bracket 42 to dispose the guard bar 30 at a substantially horizontal position, or at a slight downwardly angled configuration in relation to the horizontal plane formed by a perimeter of the press head 14 when positioned in the operative position against the pressing surface 28 (see FIG. 1). The connection of the bar rear portion 36 to the rear bar bracket 42 is adjustable to allow changing the angle of extension of the guard bar 30 around the press head 14. As the guard bar 30 is manipulated by an operator, pivoting occurs for the support member 44 at the pivoting connection 48, providing a movement of the guard bar 30 in advance of the downwardly movement of the press head 14 when moved to the closed, operative position 32" on the pressing surface 28. A time delay for movement of the press head 14 after manipulation of the guard bar 30 is created by the actuation of the connector means 40, actuation of the activation frame 60 with reciprocation of valves 22, 24, and transmission of pneumatic pressure to pressure lever 18 and support lever arm 20. The angled configuration of the guard bar 30 in relation to the press head 14, in concert with the pivoting of support member 44 at pivoting connection 48 and the time delay created by actuation of the connector means 40 as described above, further allows the guard bar 30 to advance ahead of the downwardly movement of the press head 14 when moved to the closed, operative position 32" on the pressing surface 28. If the guard bar 30 is obstructed by an obstacle during the downwards movement 32", the support lever arm 20 and press head 14 are moved upwards by springs 20', 20". The guard bar 30 is illustrated in operative and inoperative positions (see FIGS. 1–3), providing protection to the operator by the angled configuration and movement of the guard bar 30, and due to the positioning of the rear portion 36, side portions 34, 34', and the front portion 32 of the guard bar 30 in spaced apart orientation to encircle the press head 14.

The connector means 40 includes the support member 44 having the pivotable connection 48, with the support member 44 positioned to reciprocate the connector means 40 connected at an upper portion to the support member 44. The connector means 40 provides mechanical linkage between the support member 44 and an activation system 26, and is disposed to transmit movement of the guard bar rear portion 36, bar bracket 42 and support member 44 to activate movement of an activation frame 60 positioned to reciprocate with resulting activation of valve means including at least one actuatable valve 22, or preferably to actuate at least two actuatable valves 22, 24 in pneumatic communication with a source of pneumatic power. The connector means 40 includes a series of connector members such as at least one rigid connector 50 and at least one pivot and/or swivel connector 52 that are operator-responsive to an operator's manipulation of the guard bar 30. Upon movement of the guard bar 30 to an inoperative, upwards position, the support member 44 is pivoted upwards about pivotable connection 48. A connector 46 is moved 46' with upwards movement of support member 44, with resulting movement 50' of rigid connector 50 and resulting movement 52' of lower swivel connector 52 attached to an activation frame 60 (see FIG. 1).

Figure 3:
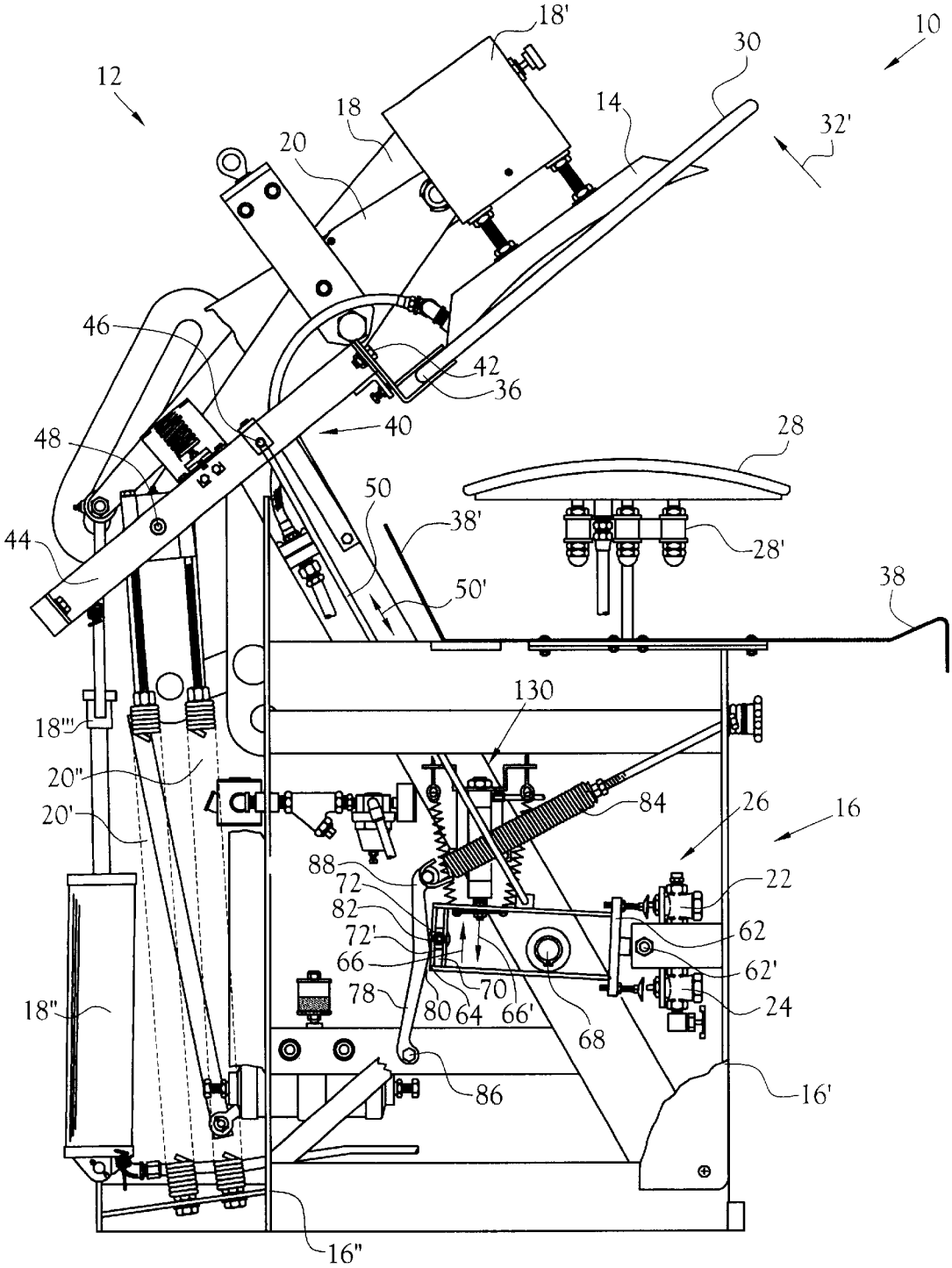
FIG. 3 is a side view of the press machine of FIG. 1, illustrating a peripheral guard bar in an inoperative position above a pressing surface.

The operator responsive mechanism and connector means 40 operates when the guard bar 30 is manipulated upwards 32' to an open position for the press head 14, with the raising 66 of the activation frame 60 until contact is made against stop member 68 as illustrated in FIG. 3. When guard bar 30 is manipulated downwards 32" to a closed position for the press head 14, connector means 40 is rotated downwards with the lowering 66' of the activation frame 60 until contact is made against stop member 68 as illustrated in FIG. 1. The activation frame 60 is supported at the first end 62 by a pivoting connection 62' to a front support frame 16, to allow pivoting of the first end 62. The first end 62 is disposed to actuate upper valve 22 and lower valve 24 for control of pneumatic fluid flow to the piston and cylinder 18" for extension of piston rod 18'" and cantilevered movement of pressure lever 18, support lever arm 20, and press head 14 between an inoperative position 32' (see FIG. 3) and an operative position 32" (see FIG. 1).

The operator responsive mechanism further includes the activation frame 60 having a second end 64, also referred to as the reciprocating end 64, that is supported in a cantilevered orientation in reference to the first end 62, to allow the reciprocating end 64 to be repetitively repositioned between the raised position 66 (see FIG. 3), and the lowered position 66' (see FIG. 1). The activation frame 60 includes an interior slot 70 into which a roller 72 protrudes, with the outer perimeter 72' of the roller 72 extended to contact against a lever 78 disposed proximal to the reciprocating end 64. The reciprocating end 64 is repetitively raised 66 and lowered 66' as the connector rod 50 is moved 50', resulting in displacement of the connector joint 52 and activation frame 60 as a result of movement of the guard bar 30 by the operator. The roller 72 is positioned to have the outer perimeter 72' that contacts a curved side 80 of lever 78 (see FIG. 3). As outer perimeter 72' moves along curved side 80 with the movement of reciprocating end 64, the roller 72 is rotated against a rounded mid-portion 82 of lever 78 which is pivotably connected at a pivot end 86 to a cross-member of support frame 16', 16". As the operator manipulates the guard bar 30, the activation frame 60 moves up and down, and outer perimeter 72' of roller 72 moves along curved side 80 during each up and down movement of reciprocating end 64 of activation frame 60. The interaction of the outer perimeter 72' against the curved side 80, in combination with the tension maintained by a spring 84 attached to lever free end 88, provides spring tension to maintain lever 78 against outer perimeter 72' of roller 72, and provides a means for rapid reciprocation of the activation frame 60 between a raised 66 and a lowered 66' position, as the operator-manipulates guard bar 30 and press head 14 between an open position 32' (see FIG. 3), or a downwards position 32" (see FIG. 1).

During reciprocation of the activation frame 60, the pivoting of first end 62 provides for actuation of two independently actuator valves 22, 24 which regulate the supply of pneumatic fluid such as pressurized air utilized to extend or to allow retraction of piston rod 18'" of piston and cylinder 18" disposed to move cantilevered pressure lever 18 and press head 14. The transfer of pressurized air by the two independently actuator valves 22, 24 provides control of movement of press head 14 in concert with movement by an operator of guard bar 30. The sequence of events for movement of the guard bar 30 and the press head from an open, inoperative position 32', to a closed, operative position 32" includes the following steps. The operator manipulates the guard bar 30 downwards 32", with the initial movement of the guard bar 30 leading the movement of the press head 14. Support member 44, connector 50 and the second end 64 of frame 60 are moved in a downwardly direction 66'. Frame 60 activates actuator valves 22, 24, which allow transmittal of air pressure to piston and cylinder 18", with extension of piston rod 18'", with resulting movement of lever arm 20, pressure lever 18, press head support 18' and press head 14 into the operative position 32" (see FIG. 1). When the guard bar 30 is obstructed by an obstacle during the downwards movement 32", the support lever arm 20 and press head 14 are moved upwards by springs 20', 20". If pneumatic fluid is interrupted to the press machine 12, a safety system is needed to protect the operator from unwarranted closure of the press head 14, and for automatic opening of the press head 14 if pneumatic fluid is interrupted to the press machine 12. As illustrated in FIGS. 1, 3, 4A–4C, a deactivation device 130 is positioned proximal to the activation frame 60 to control movement of the activation frame 60 when pneumatic fluid such as pressurized air is interrupted to the press machine 12.

Figure 4A:
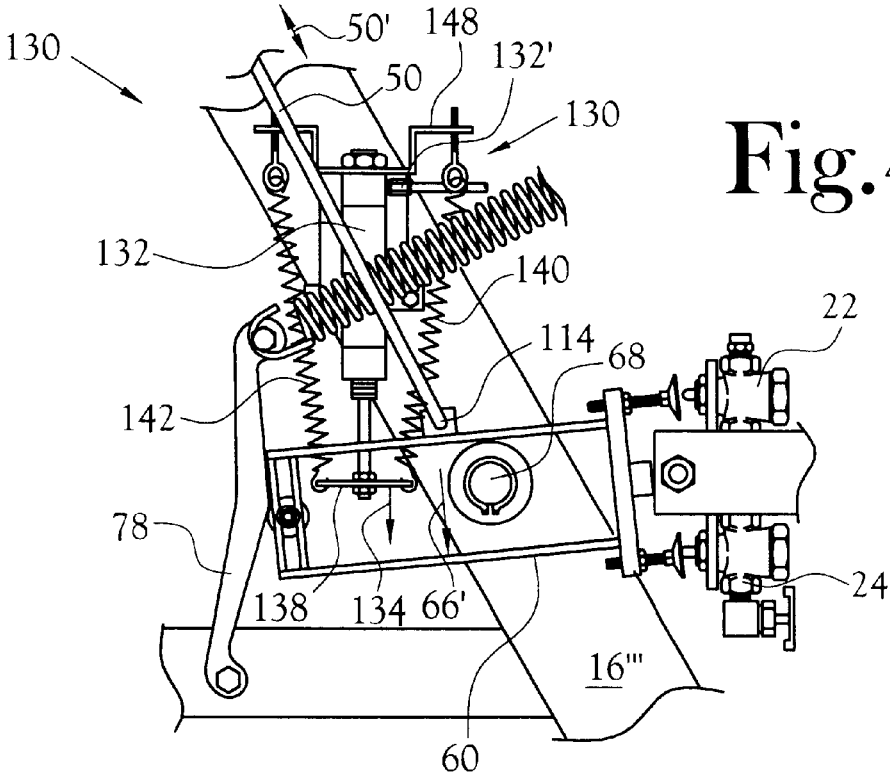
FIG. 4A is a side view of an activation system and deactivation device of the press machine of FIG. 1, illustrating an activation mechanism reciprocated to a lower position and the deactivation device in a lower position when pneumatic fluid flow is supplied to the garment finishing press.
Figure 4B:
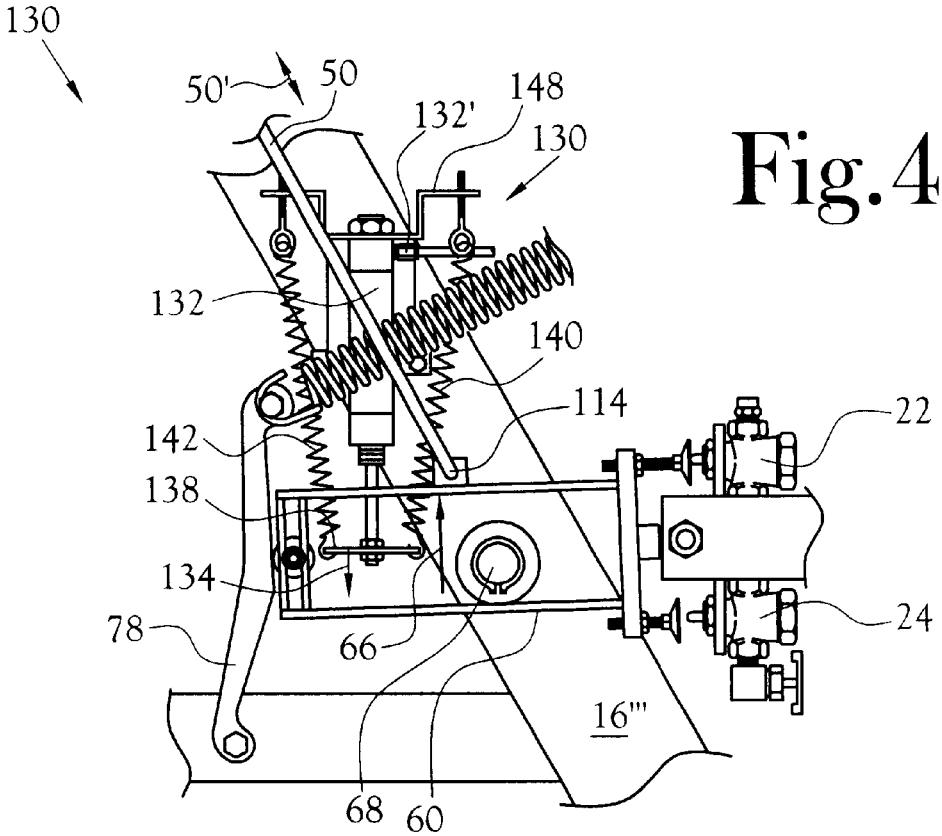
FIG. 4B is a side view of FIG. 4A, illustrating the activation device in a raised position and the deactivation device in a lower position when pneumatic fluid flow is applied to the garment finishing press.
Figure 4C:
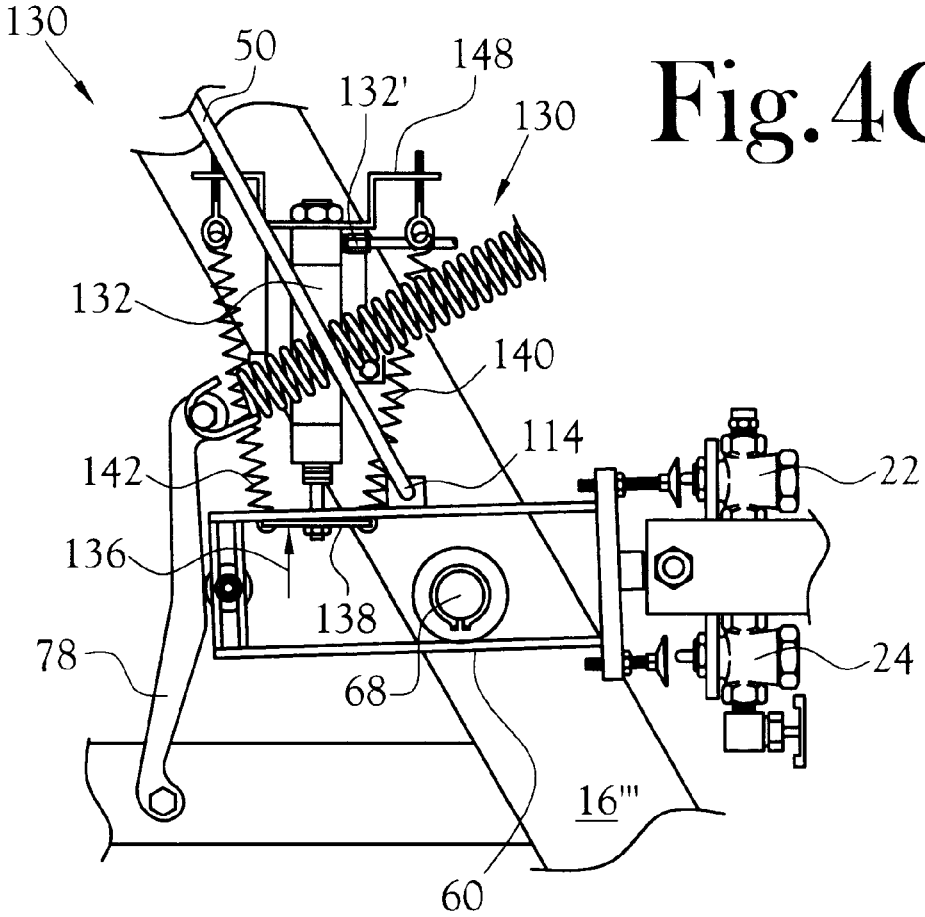
FIG. 4C is side view of FIG. 4A, illustrating the activation device maintained in a raised position by the deactivation device maintained in a raised position when pneumatic fluid flow is interrupted to the garment finishing press.

The deactivation device 130 is illustrated in FIGS. 4A–4C. The deactivation device 130 is positioned above and adjacent to the activation frame 60. An alternate position is feasible, such as positioning the deactivation device 130 below (not shown) the activation frame 60. The deactivation device 130 includes a piston means having a piston and cylinder 132 with a piston base end to which a piston valve connector 132' allows for a hose connection to provide pneumatic fluid flow communication with the source of pressurized air providing pneumatic power to the press machine 12. The piston and cylinder 132 includes an extendable piston rod having a distal end with a flanged bracket 138 affixed thereon for selective engagement of the activation frame 60. The flanged bracket 138 is disposed adjacent to, but is not connected to a side portion of the activation frame 60. In the embodiment illustrated in FIGS. 4A and 4B, the flanged bracket 138 is positioned under the upper portion of the frame 60, and in an extended position 134 when pressurized air is applied to the press machine 12. Therefore, when pressurized air is supplied to the press machine 12, and to piston valve connector 132', the flanged bracket 138 and piston rod end of the piston and cylinder 132 remain extended 134, without interfering with the reciprocating movement 66, 66' of the activation frame 60. The piston and cylinder 132 is attached at the cylinder base end to a stationary bracket 148 attached to the support member 16'". At least one spring 140 is positioned adjacent the piston and cylinder 132, or preferably a pair of springs 140, 142 that each have a first end attached to the flanged bracket 138, and each have a second end attached to the stationary bracket 148. The flanged bracket 138 remains in an extended position 134 as long as the air pressure to piston and cylinder 132 exceeds the force of recoil of the springs 140, 142. When air pressure is interrupted to the piston and cylinder 132, the flanged bracket 138 and respective piston rod end of the piston and cylinder 132 are moved to a retracted position 136 (see FIG. 4C) by the recoil force of springs 140, 142. Flanged bracket 138 remains in the retracted position 136 due to the tension provided by springs 140, 142, as long as air pressure is interrupted to piston valve connector 132', with resulting restraint on movement of frame 60 of the activation system 26, which restrains the reciprocation of valves 22, 24, with temporary cessation of pneumatic fluid flow to piston and cylinder 18", resulting in retraction of piston rod 18'" and movement upwards 32' of guard bar 30 and press head 14 to an inoperative position.

Upon resupply of air pressure to piston valve connector 132', with air pressure greater than the recoil force of springs 140, 142, flanged bracket 138 and piston rod end are extended to an extended position 134 from the piston and cylinder 132, thereby allowing movement of the frame 60 of the activation device 26. Upon the automatic resetting of flanged bracket 138 to an extended position 134 (see FIGS. 4A and 4B), the frame 60 freely reciprocates upon the manipulation by the operator of the guard bar 30, with resulting activation of actuatable valves 22, 24, and resumption of the transfer of pressurized air to piston and cylinder 18", resulting in extension of piston rod 18'" and movement downwards 32" of guard bar 30 and press head 14 to an operative position.

Figure 6:
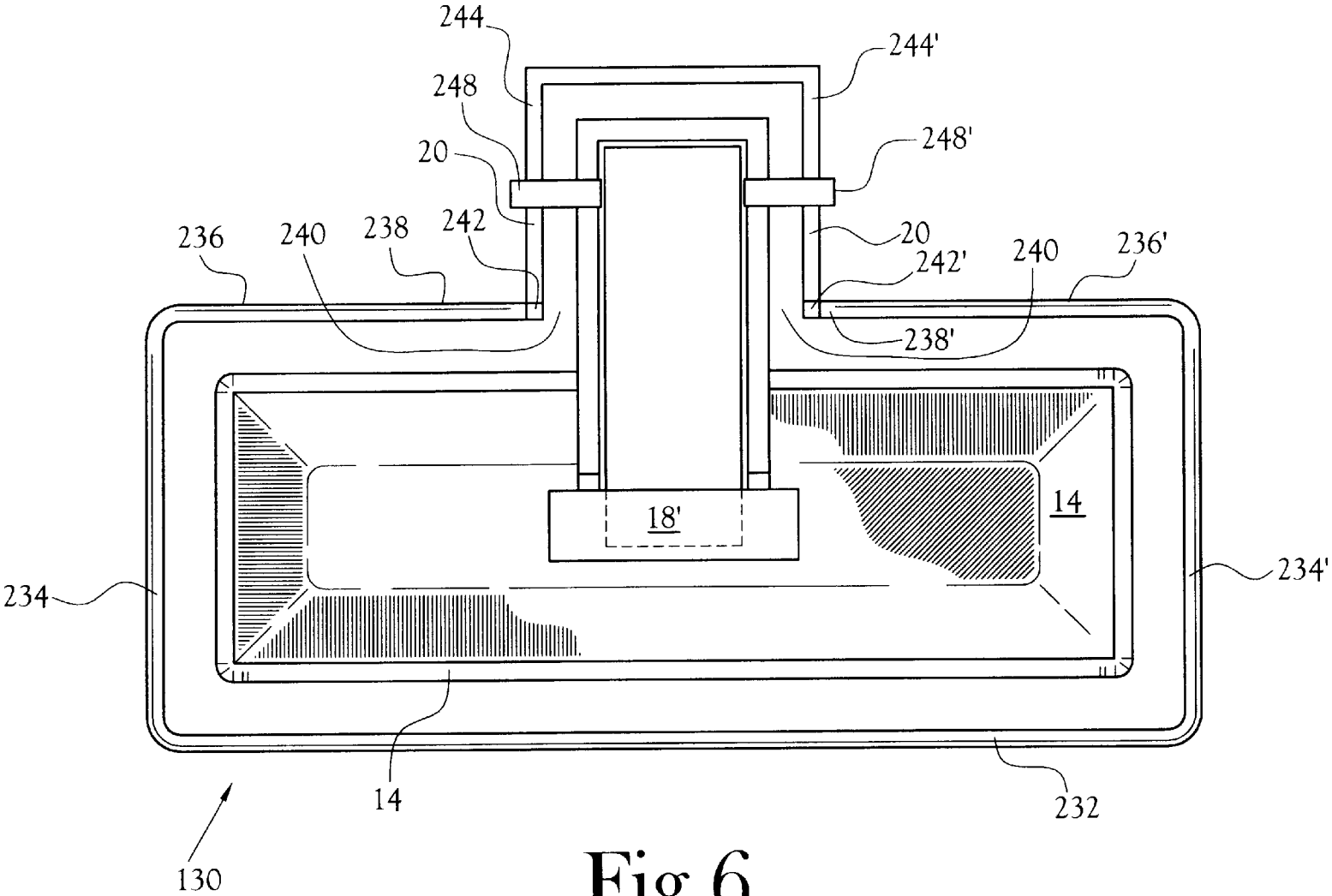
FIG. 6 is a top view of FIG. 1, illustrating an alternative embodiment of a peripheral guard bar of the present invention.

An alternative embodiment of the peripheral guard bar 230 is illustrated in FIG. 6. The peripheral guard bar 230 includes a front bar 232, a first side portion 234 and a second side portion 234', and rear bar section 236, 236' that provide a guard bar 230 that encircles a major portion of the press head 14. The rear bar section 236, 236' includes a central opening 240 between interior ends 238', 238" of rear bar sections 236, 236' that provides an opening 240 of adequate width to prevent the rear bar sections 236, 236' from contacting a wide support lever arm 20, and/or a wide pressure lever 18 when the support lever arm 20, pressure lever 18, and press head 14 are positioned in the downwards position 32" (see FIG. 1). Each interior end 238, 238' is connected by respective rear brackets 242, 242' to support members 244, 244' that are pivotably attached to the support lever arm 20 and/or a wide pressure lever 18 at respective pivot points 248, 248'. A support lever arm 20 and/or a wide pressure lever 18 is reciprocated between an upwards, inoperative position 32', to a downwards, operative position 32" without contact with the respective rear bar sections 236, 236' of guard bar 30.

A method of operation for use of the peripheral guard apparatus 10 is disclosed that includes a step of manipulating a guard bar 30 for controlled movement for a press head 14 of a garment finishing press 12. The step of manipulating includes a step of positioning a guard bar 30 to encircle the press head 14. The guard bar 30 is attachable at a bar rear portion 36 to a connector means 40 including a support member 44 connected by a pivotable connection 48 to a rigid connector 50 connecting to an activation system 26. The connector means 40 provides mechanical linkage between the support member 44 and an activation system 26. The manipulating step is controlled by an operator's manipulation of the guard bar 30 to activate movement of the press head 14 between an inoperative position 32' above a pressing surface 28, and an operative f position 32" against the pressing surface 28. The manipulating step proceeds in concert with a transmitting step including movement by the guard bar 30 transmitted by a connector means 40 to an activation system 26 that is in pneumatic communication with a source of pneumatic power. The transmitting step links movement of the activation system 26 with a step of actuating of at least one valve means for transmission of pneumatic power to a piston and cylinder means 18" for repetitive movement of the press head 14 between a first, inoperative position to a second, operative position in concert with the movement of the guard bar 30 between the inoperative position and the operative position.

The method of operation further includes a step of resetting the activation system 26 by manipulating the guard bar 30 upwards to the inoperative position 32'. The step of resetting positions the guard bar 30 and the press head 14 to the inoperative position 32' and includes the associated steps of moving the connector means 40 that provides mechanical linkage between the support member 44 and the activation system 26. Upon movement of the connector means 40, the reciprocation of activation frame 60 provides for actuating of the at least one valve means 22, 24 for exhausting of pressurized air from piston and cylinder means 18" with retraction of piston rod 18'". Upon exhausting of pressurized air from piston and cylinder means 18", the pressure lever 18 and support lever arm 20 are lifted upwards by springs 20', 20", and the press head 14 is moved from the operative position 32" to the inoperative position 32'. The steps of manipulating and resetting allow the guard bar 30 to lead the movement of the press head 14 when reciprocated from a first, inoperative 32' position to a second, operative 32". The method of operation protects the operator's body parts from entrapment under the press head 14 by advancing the guard bar 30 downwards upon manipulation by an operator in advance of downwards movement of the press head 14 downwards to an operative position 32". The method of operation provides for upwards movement of press head 14, upon manipulation upwards of the guard bar 30 by an operator to an upwards, inoperative position 32' for the press head 14.

While the present invention has been illustrated by description of several embodiments and while the illustrative embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicants' general inventive concept.

Having thus described the aforementioned invention, we claim:

1. A safety guard apparatus for movement of a support lever arm attached to a press head of a press machine powered by a source of pneumatic power providing pneumatic fluid flow to operate the press head between inoperative and operative positions controlled by at least one actuatable valve, comprising:

a guard bar connectable to a connector means, said guard bar is manipulated by an operator to move said connector means for activation of the at least one actuatable valve being in pneumatic communication with the pressurized fluid flow system of the press machine for transmission of pneumatic fluid for movement of the press head between an inoperative position to an operative position, said guard bar is configured to encircle the press head, said guard bar is disposed to be moved in advance of movement of the press head between said inoperative and operative positions; and an operator-responsive mechanism interposed between said connector means and the at least one actuatable valve, said operator-responsive mechanism including at least one pivotable connection and a means for connecting disposed between said connector means and the at least one actuatable valve, said means for connecting is reciprocated upon said guard bar being moved in advance of movement of the press head, thereby said operator-responsive mechanism is responsive to the movement of said guard bar and said press head between inoperative and operative positions to activate the at least one actuatable valve for regulation of the transmission of pneumatic power to operate the press head between inoperative and operative positions, said operator-responsive mechanism further including:

an activation system disposed to be reciprocated by said means for connecting, said activation system positioned to actuate the at least one actuatable valve between inoperative and operative valve positions, said activation system including:

an activation frame having a first end that is reciprocated about a pivot attached at said first end to a structural member of the press machine, said first end is disposed to reciprocatingly actuate the at least one actuatable valve, said activation frame having a second end reciprocated between a raised and a lowered position, said second end supporting a roller means disposed to reciprocate against a lever arm attached by a pivoting connector to the structural member of the press machine, said lever arm is spring tensioned to maintain contact against said roller means supported by said second end;

whereby actuating of the at least one actuatable valve between respective inoperative and operative valve positions regulates the pneumatic fluid flow pressure applied to the support lever arm for movement of the press head between inoperative and operative positions.

2. The safety guard apparatus of claim 1 wherein said guard bar includes a front portion, a first and second side portions, and a rear portion having first and second ends attached at a central bracket to said connector means, said central bracket is articulated to dispose said guard bar to encircle a perimeter of the press head when said guard bar is positioned in the operative position in concert with movement of the support lever arm and the press head to the operative position, said guard bar front portion, said first and second side portions and said rear portion are positioned a spaced apart distance from the press head.

3. The safety guard apparatus of claim 2 wherein said guard bar includes said rear portion having first and second ends separated by an opening between said first and second ends, said first and second ends attached to respective sides of said connector means, said connector means is articulated to dispose said guard bar below a horizontal plane described by the press head, said guard bar encircles a perimeter of the press head when said guard bar is positioned in the operative position in concert with movement of the support lever arm and the press head to the operative position, said guard bar front portion, rear portion, and first and second side portions are positioned a spaced apart distance from the press head.

4. A safety guard apparatus for movement of a support lever arm attached to a press head of a press machine powered by a source of pneumatic power providing pneumatic fluid flow to operate the press head between inoperative and operative positions controlled by at least one actuatable valve, comprising:

a guard bar connectable to a connector means, said guard bar is manipulated by an operator to move said connector means for activation of the at least one actuatable valve being in pneumatic communication with the pressurized fluid flow system of the press machine for transmission of pneumatic fluid for movement of the press head between an inoperative position to an operative position, said guard bar is configured to encircle the press head, said guard bar is disposed to be moved in advance of movement of the press head between said inoperative and operative positions;

an operator-responsive mechanism interposed between said connector means and the at least one actuatable valve, said operator-responsive mechanism including at least one pivotable connection and a means for connecting disposed between said connector means and the at least one actuatable valve, said means for connecting is reciprocated upon said guard bar being moved in advance of movement of the press head, thereby said operator-responsive mechanism is responsive to the movement of said guard bar and said press head between inoperative and operative positions to activate the at least one actuatable valve for regulation of the transmission of pneumatic power to operate the press head between inoperative and operative positions, said operator-responsive mechanism further including:

an activation system disposed to be reciprocated by said means for connecting, said activation system positioned to actuate the at least one actuatable valve between inoperative and operative valve positions, said activation system including:

an activation frame having a first end that is reciprocated about a pivot attached at said first end to a structural member of the press machine, said activation frame having a second end reciprocated between a raised and a lowered position, said activation frame second end supporting a roller means disposed to reciprocate against a lever arm attached by a pivoting connector to the structural member of the press machine, said lever arm is spring tensioned to maintain contact against said roller means of said second end;

the at least one actuatable valve including a first and a second pressure control valve positioned proximate to said first end of said activation frame, said first and said second pressure control valve being actuated between respective open and closed configurations as said activation frame is reciprocated, said first and said second pressure control valves are in pneumatic communication with the pressurized fluid flow system of the press machine; and a stop member being positioned within said activation frame, said stop member restricts the reciprocating motion of said activation frame between said raised position and said lowered position of said activation frame;

whereby actuating of said first and second pressure control valves between respective open and closed configurations regulates the pneumatic fluid flow pressure applied to the support lever arm for movement of the press head between inoperative and operative positions.

5. In a press machine powered by a source of pneumatic power and having a structural member supporting a support lever arm attached to a press head wherein the operation of the support lever arm and the press head between operative and inoperative positions is controlled by at least one actuatable valve in communication with the source of pneumatic power, the improvement comprising:

an operator responsive mechanism responsive to the movement of the press head between its operative and inoperative positions and interposed between the press head and the at least one actuatable valve;

a guard bar manipulated by an operator between operative and inoperative positions, said guard bar is supported by a pivotable connector means connecting to said operator responsive mechanism disposed to reciprocate the at least one actuatable valve, said guard bar is disposed by said pivotable connector means to move ahead of movement of the press head between said inoperative and operative positions;

at least one connector attached at a first end to said connector means, said at least one connector is reciprocated in response to movement of said connector means, said at least one connector having a second end disposed to extend downwardly from said connector means;

an activation frame connected to said second end of said at least one connector, said activation frame is reciprocated at a first end about a pivot end upon manipulation of the guard bar between operative and inoperative positions;

said activation frame having a second end reciprocated between a raised and a lowered position, said activation frame second end supporting a roller means disposed to reciprocate against a lever arm attached by a pivoting connector to the structural member of the press machine, said lever arm is spring tensioned to maintain contact against said roller means of said second end; and the at least one actuatable valve including a first and a second pressure control valve positioned proximate to respective corners of said pivot end of said activation frame, said first and second pressure control valves being actuated between operative and inoperative positions for control of pressurized air provided by the source of pneumatic power, said first and second pressure control valves operate to move the press head as said activation frame is reciprocated, said first and second pressure control valves are in pneumatic communication with the source of pneumatic power of the press.

6. The improvement of claim 5 wherein said activation frame further includes a stop member being positioned within said activation frame, said stop member restricts the reciprocating motion of said activation frame during actuation of said first and second pressure control valves being actuated between operative and inoperative positions.

7. The improvement of claim 5 wherein said guard bar includes a front portion, a first side portion, a second side portion, and a rear portion having first and second ends attached at a central bracket to said connector means, said central bracket is articulated to dispose said guard bar to encircle a perimeter of the press head when said guard bar is positioned in the operative position in concert with movement of the support lever arm and the press head to the operative position, said respective front portion, said first side portion, said second side portion, and said rear portion are positioned a spaced apart distance from the press head.

8. A safety guard apparatus for movement of a support lever arm attached to a press head of a press machine powered by a source of pneumatic power to operate the press head between inoperative and operative positions controlled by at least one actuatable valve, comprising:

a guard bar connectable to a connector means, said guard bar is manipulated by an operator to move said connector means for activation of the at least one actuatable valve for movement of the press head between inoperative and operative positions, said guard bar is extended from said connector means to encircle the press head, said guard bar is disposed to be moved in advance of movement of the press head between said inoperative and operative positions;

an operator-responsive mechanism interposed between said connector means and the at least one actuatable valve, said operator-responsive mechanism including at least one pivotable connection and a means for connecting disposed between said connector means and the at least one actuatable valve, said operator-responsive mechanism is responsive to the movement of said guard bar between inoperative and operative positions to activate the at least one actuatable valve for regulation of the transmission of pneumatic power to operate the press head between inoperative and operative positions; and an activation system positioned to actuate the at least one actuatable valve between inoperative and operative valve positions, said activation system connectable at a pivotable connection to said means for connecting, said activation system reciprocated by said means for connecting upon manipulation of said guard bar by the operator;

whereby said inoperative and operative valve positions regulate the pneumatic pressure applied to the support lever arm attached to the press head for movement between inoperative and operative positions;

at least one connector attached at a first end to said connector means, said at least one connector is reciprocated in response to movement of said connector means, said at least one connector having a second end disposed to extend downwardly from said connector means;

an activation frame connected to said second end of said at least one connector, said activation frame is reciprocated at a first end about a pivot end upon manipulation of the guard bar between operative and inoperative positions;

said activation frame having a second end reciprocated between a raised and a lowered position, said activation frame second end supporting a roller means disposed to reciprocate against a lever arm attached by a pivoting connector to the structural member of the press machine, said lever arm is spring tensioned to maintain contact against said roller means of said second end; and a first and a second pressure control valve positioned proximate to respective corners of said pivot end of said activation frame, said first and second pressure control valves being actuated between operative and inoperative positions for control of pressurized fluid provided by the source of pneumatic power, said first and second pressure control valves operate to move the press head as said activation frame is reciprocated, said first and second pressure control valves are in pneumatic communication with the source of pneumatic power of the press.

9. The safety guard apparatus of claim 8 wherein said guard bar includes a front portion, a first and second side portions, and a rear portion having first and second ends attached at a central bracket to said connector means, said central bracket is articulated to dispose said guard bar to encircle a perimeter of the press head below a horizontal plane of the press head when said guard bar is positioned in the operative position in concert with movement of the support lever arm and the press head to the operative position, said guard bar front portion, rear portion, and first and second side portions are positioned a spaced apart distance from the press head.

10. The safety guard apparatus of claim 8 wherein said guard bar includes a front portion, a first and second side portions, and a rear portion having first and second ends separated by an opening between said first and second ends, said first and second ends attached to respective sides of said connector means, said connector means is articulated to dispose said guard bar to encircle a perimeter of the press head when said guard bar is positioned in the operative position in concert with movement of the support lever arm and the press head to the operative position, said guard bar front portion, said rear portion, and said first and second side portions are positioned a spaced apart distance from the press head.

11. A method of operation of a peripheral guard system for controlling pneumatic power to a piston and cylinder means for movement of a press head in relation to a pressing surface of a garment press activated by pneumatic fluid flow provided by a source of pneumatic power, comprising the steps of:

manipulating a guard bar encircling the press head, said manipulating step moves said guard bar in advance of movement of the press head by the piston and cylinder means between an inoperative position and an operative position;

transmitting movement of said guard bar by a connector means extending to an activation system including an activation frame connected by said connector means extending from said guard bar, said activation frame is reciprocated upon said step of manipulating said guard bar between operative and inoperative positions, said step of transmitting linking the movement of said activation system between a first position and a second position with the movement of said guard bar between said inoperative position and said operative position; and actuating at least one valve means in pneumatic communication with a source of pneumatic power, said step of transmitting linking the movement of said activation system including said reciprocated activation frame with actuating of said at least one valve means for transmission of pneumatic power to the piston and cylinder means for repetitive movement of the press head between said operative position and said inoperative position;

wherein said step of manipulating initiates reciprocation of said activation system for actuation of the at least one actuatable valve for control of pneumatic fluid flow to repetitively move the press head between positions alternating between inoperative and operative positions.

12. The method of claim 11 further includes the step of resetting said activation system by a second step of manipulating said guard bar upwards to said inoperative position, said step of resetting positions said guard bar and the press head to said inoperative position with associated steps of transmitting movement and actuating said at least one valve means with said reciprocated activation frame for release of pneumatic power to the piston and cylinder means for movement of the press head between said operative position to said inoperative position as controlled by the operator.

* * * * *